US007633498B2

(12) United States Patent
Kang et al.

(10) Patent No.: US 7,633,498 B2
(45) Date of Patent: Dec. 15, 2009

(54) DISPLAY DRIVER WITH CHARGE PUMPING SIGNALS SYNCHRONIZED TO DIFFERENT CLOCKS FOR MULTIPLE MODES

(75) Inventors: Won-Sik Kang, Hwasung-si (KR); Jae-Koo Lee, Hwasung-si (KR); Jae-Hoon Lee, Yongin (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 673 days.

(21) Appl. No.: 10/987,783

(22) Filed: Nov. 12, 2004

(65) Prior Publication Data

US 2005/0110784 A1 May 26, 2005

(30) Foreign Application Priority Data

Nov. 20, 2003 (KR) ..... 10-2003-0082650

(51) Int. Cl.
*G09G 3/36* (2006.01)
*G09G 5/00* (2006.01)

(52) U.S. Cl. ..... 345/213; 345/98

(58) Field of Classification Search ..... 345/98, 345/99, 212, 213

See application file for complete search history.

(56) References Cited

U.S. PATENT DOCUMENTS

2002/0044118 A1 4/2002 Sekido et al.
2003/0011586 A1 1/2003 Nakajima
2004/0095342 A1 * 5/2004 Lee et al. ..... 345/211

OTHER PUBLICATIONS

Korean Patent Application No. 1020000036226 to Baek with title "LCD having Multi-Timing Controller" (w/ English Abstract page), published: Sep. 1, 2002.

* cited by examiner

*Primary Examiner*—Amr Awad
*Assistant Examiner*—Randal Willis
(74) *Attorney, Agent, or Firm*—Monica H. Choi

(57) ABSTRACT

A display driver generates a respective charge pumping signal and respective driving signals synchronized to a respective same clock signal for each of the CPU and video interface modes. Because such respective signals are synchronized to a respective same clock signal, the noise superimposed on the driving signals applied on a display panel is regular and uniform across the whole display panel, for each of the CPU and video interface modes. Accordingly, affects of such regular noise are advantageously not noticeable to the human eye, for both the video and CPU interface modes of operation.

58 Claims, 12 Drawing Sheets

DISPLAY DRIVER WITH CHARGE PUMPING SIGNALS SYNCHRONIZED TO DIFFERENT CLOCKS FOR MULTIPLE MODES

CROSS-REFERENCE TO RELATED APPLICATION(S)

The present application claims priority under 35 U.S.C. §119 to Korean Patent Application No. 2003-0082650, filed on Nov. 20, 2003, which is incorporated herein by reference in its entirety.

TECHNICAL FIELD

The present invention relates generally to a display driver, such as for a LCD (liquid crystal display), and more particularly, to synchronizing charge pumping signals to different clock signals for video and CPU interface modes of operation to reduce adverse affects of noise.

BACKGROUND OF THE INVENTION

FIG. 1 shows a block diagram of a typical display driver 100, such as for a LCD (liquid crystal display) panel 102, operating in a video interface mode. Components, such as the LCD panel 102, a CPU 104, and a graphic processor 106, that are not part of the display driver 100 in FIG. 1 are shown outlined in dashed lines. The display driver 100 operates in a video interface mode for processing video data resulting in moving images on the LCD panel 102.

For the video interface mode, the CPU 104, which is a data processing unit, sends control signals (CTRLS) to a graphic processor 106 indicating that the graphic processor 106 is to process video data. The graphic processor 106 then sends such video data (VIDEO_DATA), a system clock (DOTCLK), and synchronization signals (H_SYNC and V_SYNC) to a timing controller 108 of the display driver 100.

The display driver 100 includes the timing controller 108, an oscillator 110, a voltage controller 112, a data line driver 114, a scan line driver 116, and a common voltage (VCOM) generator 118. The timing controller 108 uses the VIDEO_DATA, DOTCLK, and H_SYNC signals from the graphic processor 106 to generate synchronized S_DATA signals for the data line driver 114 to control timing of data line signals generated from the data line driver 114 and applied on data lines S1, S2, . . . , and Sm of the LCD panel 102.

Similarly, the timing controller 108 uses the DOTCLK and V_SYNC signals from the graphic processor 106 to generate gate signals for the scan line driver 115 to control timing of gate line signals generated from the scan line driver 116 and applied on gate lines G1, G2, . . . , and Gn of the LCD panel 102. Furthermore, the timing controller 108 uses the DOTCLK signal from the graphic processor 106 to generate an initial common voltage (VCOM') signal for the VCOM generator 118 to control timing of a common voltage (VCOM) signal generated from the VCOM generator 118 and applied on a common node of the LCD panel 102.

The voltage controller 112 includes at least one charge pump for generating at least one DC voltage. A typical charge pump used in a display driver generates a DC voltage that is a multiple of a reference voltage (Vref) when pumped by a charge pumping signal (DCCLK). Examples of such charge pumps in the prior art are disclosed in U.S. Patent Application Publication No. US 2003/0011586 to Nakajima and U.S. Patent Application Publication No. US 2002/0044118 to Sekido et al.

At least one DC voltage (DCV1) is generated by the voltage controller 112 for the data line driver 114 to control the magnitude of the respective data line signal applied on each of the data lines S1, S2, . . . , and Sm. Similarly, at least one DC voltage (DCV2) is generated by the voltage controller 112 for the scan line driver 116 to control the magnitude of the respective gate line signal applied on each of gate lines G1, G2, . . . , and Gn. Furthermore, a DC voltage (DCV3) is generated by the voltage controller 112 for the VCOM generator 118 to control the magnitude of the VCOM signal applied on the common node of the LCD panel 102.

The timing controller 108 generates the Vref used by the at least one charge pump within the voltage controller 112 such that the timing controller 108 controls the magnitude of the driving signals applied on the LDC panel 102. The driving signals applied on the LCD panel 102 include the respective data line signal applied on each of the data lines S1, S2, . . . , and Sm, the respective gate line signal applied on each of gate lines G1, G2, . . . , and Gn, and the VCOM signal applied on the common node of the LCD panel 102.

An oscillator 110 is used to generate the charge pumping signal (DCCLK) that pumps the at least one charge pump within the voltage controller 112 to generate the DC voltages DCV1, DCV2, and DCV3. In this manner, the display driver 100 processes the VIDEO_DATA, DOTCLK, H_SYNC, and V_SYNC signals from the graphic processor 106 to generate the driving signals applied on the LCD panel 102 to create moving images on the LCD panel 102 in a video interface mode. Such operations and such components 108, 110, 112, 114, 116, and 118 of the display driver 100 in FIG. 1 are known to one of ordinary skill in the art.

Referring to FIG. 2, another display driver 120 is configured to operate in a CPU interface mode for processing data resulting in a still image on the LCD panel 102. Elements having the same reference number in FIGS. 1 and 2 refer to elements having similar structure and function. A timing controller 122 of the display driver 120 operating in the CPU interface mode is directly coupled to the CPU 104. The timing controller 122 receives the image data directly from the CPU 104 in the CPU interface mode.

The timing controller 122 then uses an oscillator clock (OSC_CLK) signal generated from the oscillator 110 for synchronizing the driving signals applied on the LCD panel 102. The driving signals applied on the LCD panel 102 include the respective data line signal applied on each of the data lines S1, S2, . . . , and Sm, the respective gate line signal applied on each of gate lines G1, G2, . . . , and Gn, and the VCOM signal applied on the common node of the LCD panel 102. Such operations and such components 122, 110, 112, 114, 116, and 118 of the display driver 120 in FIG. 2 are known to one of ordinary skill in the art.

FIG. 3 shows a timing diagram of signals during operation of the display driver 120 of FIG. 2 in the CPU interface mode. Referring to FIG. 3, the OSC_CLK signal 132 and the charge pumping (DCCLK) signal 134 are synchronized to each other. Thus, each of the falling transition 136 and the rising transition 138 of the DCCLK signal 134 is synchronized to a rising edge of the OSC_CLK signal 132.

In addition, for the CPU interface mode in FIG. 3, the driving signals, such as the VCOM signal 140 for example, applied on the LCD panel 102 are also synchronized to the OSC_CLK signal 132. Thus, each of the falling transition 142 and the rising transition 144 of the VCOM signal 140 is synchronized to a rising edge of the OSC_CLK signal 132. The VCOM signal 140 in FIG. 3 is an ideal waveform without any noise imposed thereon. FIG. 3 also shows a realistic VCOM signal 146 with noise waveforms super-imposed on the ideal VCOM signal waveform.

The charge pumping (DCCLK) signal 134 is used to generate the DCV3 voltage that determines the magnitude of the VCOM signal 146. The DCCLK signal 134 is synchronized to the OSC_CLK signal 132 and is typically generated from the OSC_CLK signal 132. For example, a frequency divider is used to generate the DCCLK signal 134 having a period that is an integer multiple of the period of the OSC_CLK signal 132.

Because the DCCLK signal 134 is derived from the OSC_CLK signal 132, the noise waveform of the VCOM signal 146 is synchronized to half-periods of the OSC_CLK signal 132. In addition, because the VCOM signal 146 is also synchronized to OSC_CLK signal 132 in the CPU interface mode, the noise waveform of the VCOM signal 146 has a regular pattern across the periods of the VCOM signal 146. Thus, such regular noise applied on the LCD panel 102 causes a uniform affect repeated across the whole LCD panel 102. Such a uniform affect on the image repeated across the whole LCD panel 102 from regular noise is not noticeable to the human eye in the CPU interface mode.

FIG. 4 shows a timing diagram of signals during operation of the display driver 100 of FIG. 1 in the video interface mode. Similar to the CPU interface mode, the charge pumping (DCCLK) signal 134 is synchronized to the OSC_CLK signal 132 generated from the oscillator 110. However, for the video interface mode in FIG. 4, the driving signals, such as the VCOM signal 154, applied on the LCD panel 102 are synchronized to the system clock (DOTCLK) signal 152 from the graphic processor 106. Thus, each of the falling transition 156 and the rising transition 158 of the VCOM signal 154 is synchronized to a rising edge of the DOTCLK signal 152.

The VCOM signal 154 in FIG. 4 is an ideal waveform without any noise imposed thereon. FIG. 4 also shows a realistic VCOM signal 160 with noise waveforms super-imposed on the ideal VCOM signal waveform. The VCOM signal 160 is synchronized to the DOTCLK signal 152 that is from a different clock source 106 than the oscillator 110 that generates the OSC_CLK 132 signal. Thus, the VCOM signal 160 is not synchronized to the OSC_CLK 132 signal and the charge pumping (DCCLK) signal 134.

As a result, the noise generated from the at least charge pump does not have a regular pattern across the VCOM signal 160. The noise is particularly irregular at any falling transition 162 and any rising transition 164 of the VCOM signal 160. Such irregular noise creates non-uniform affects on the image across the LCD panel 102, and such non-uniform noise applied on the LCD panel 102 is noticeable to the human eye.

A display driver that creates images on the LDC panel 102 without such noticeable affects from noise is desired for both the CPU and video interface modes of operation. In addition, a display driver capable of operating in both the CPU and video interface modes of operation as dictated by the CPU is desired.

SUMMARY OF THE INVENTION

Accordingly, in a general aspect of the present invention, a display driver generates a charge pumping signal and display panel driving signals synchronized to a respective same clock signal for each of the CPU and video interface modes.

In one embodiment of the present invention, a display driver includes a first signal generator that generates a first charge pumping signal (DCCLK1) to be used in a video interface mode. The display driver also includes a second signal generator that generates a second charge pumping signal (DCCLK2) to be used in a CPU interface mode.

In another embodiment of the present invention, the first signal generator generates DCCLK1 to be synchronized to a first system clock signal (DOTCLK1) from a graphic processor. The driving signals applied on the display panel are also synchronized to DOTCLK1 in the video interface mode.

Similarly, the second signal generator includes an oscillator that generates a second system clock signal (DOTCLK2), and DCCLK2 is synchronized to DOTCLK2. The driving signals applied on the display panel are also synchronized to DOTCLK2 in the CPU interface mode.

In yet another embodiment of the present invention, the display driver also includes a charge pump that generates at least one DC voltage when pumped with the selected one of DCCLK1 or DCCLK2. A signal selector selects DCCLK1 to be coupled to the charge pump in the video interface mode, and selects DCCLK2 to be coupled to the charge pump in the CPU interface mode. The signal selector is coupled to a data processing unit that sends a control signal indicating one of the video interface mode or the CPU interface mode of operation.

In a further embodiment of the present invention, the first signal generator includes a clock partitioner and a signal transitioner. The clock partitioner indicates timing of each transition of DCCLK1 during a period of a synchronization signal (SYNC) as a respective number of periods of a system clock signal (DOTCLK1) from a beginning of the period of SYNC. The signal transitioner generates a transition in DCCLK1 at each of the respective number of periods of DOTCLK1 from the beginning of the period of SYNC. The clock partitioner is coupled to a graphic processor that provides DOTCLK1 and SYNC.

In one example embodiment, the clock partitioner includes a register that stores a total number (T_NUMCLK) of periods of DOTCLK1 during one period of SYNC. In addition, the clock partitioner includes a clock divider that determines, from T_NUMCLK and a desired frequency of DCCLK1, the respective number of periods of DOTCLK1 for each transition of DCCLK1 during a period of SYNC.

In this example embodiment, the signal transitioner includes a counter that counts a number of periods (NUMCLK) of DOTCLK1 from each beginning of a period of SYNC. In addition, a comparator compares NUMCLK with each of the respective number of periods of DOTCLK1 as determined by the clock divider. A pulse generator generates a pulse when NUMCLK is equal to any of the respective number of periods of DOTCLK1. A toggle flip-flop is configured to generate a transition in DCCLK1 for each pulse received from the pulse generator.

In another example embodiment, the clock partitioner includes a data storage device that stores each of the respective number of periods of DOTCLK1 for each transition of DCCLK1 during a period of SYNC. In this example embodiment, the signal transitioner also includes a counter that counts a number of periods (NUMCLK) of DOTCLK1 from each beginning of a period of SYNC. A comparator compares NUMCLK with each of the respective number of periods of DOTCLK1 as stored in the data storage device. A pulse generator generates a pulse when NUMCLK is equal to any of the respective number of periods of DOTCLK1. A toggle flip-flop is configured to generate a transition in DCCLK1 for each pulse received from the pulse generator.

The present invention may be applied to particular advantage when the display driver is for a LCD (liquid crystal display). However, the present invention may also be applied for other types of display panels.

In this manner, the display driver generates a charge pumping signal and display panel driving signals synchronized to DOTCLK1 in the video interface mode and to DOTCLK2 in the CPU interface mode. Because such signals are synchronized to a respective same clock signal for each of the video and CPU interface modes, the noise superimposed on the driving signals is regular and uniform across the whole display panel so that affects of such noise are not noticeable to the human eye in both the video and CPU interface modes.

These and other features and advantages of the present invention will be better understood by considering the following detailed description of the invention which is presented with the attached drawings.

BRIEF DESCRIPTION OF THE DRAWINGS

The figures referred to herein are drawn for clarity of illustration and are not necessarily drawn to scale. Elements having the same reference number in FIGS. 1, 2, 3, 4, 5, 6, 7, 8, 9, 10, 11, 12, and 13 refer to elements having similar structure and function.

DETAILED DESCRIPTION

Figure 5:
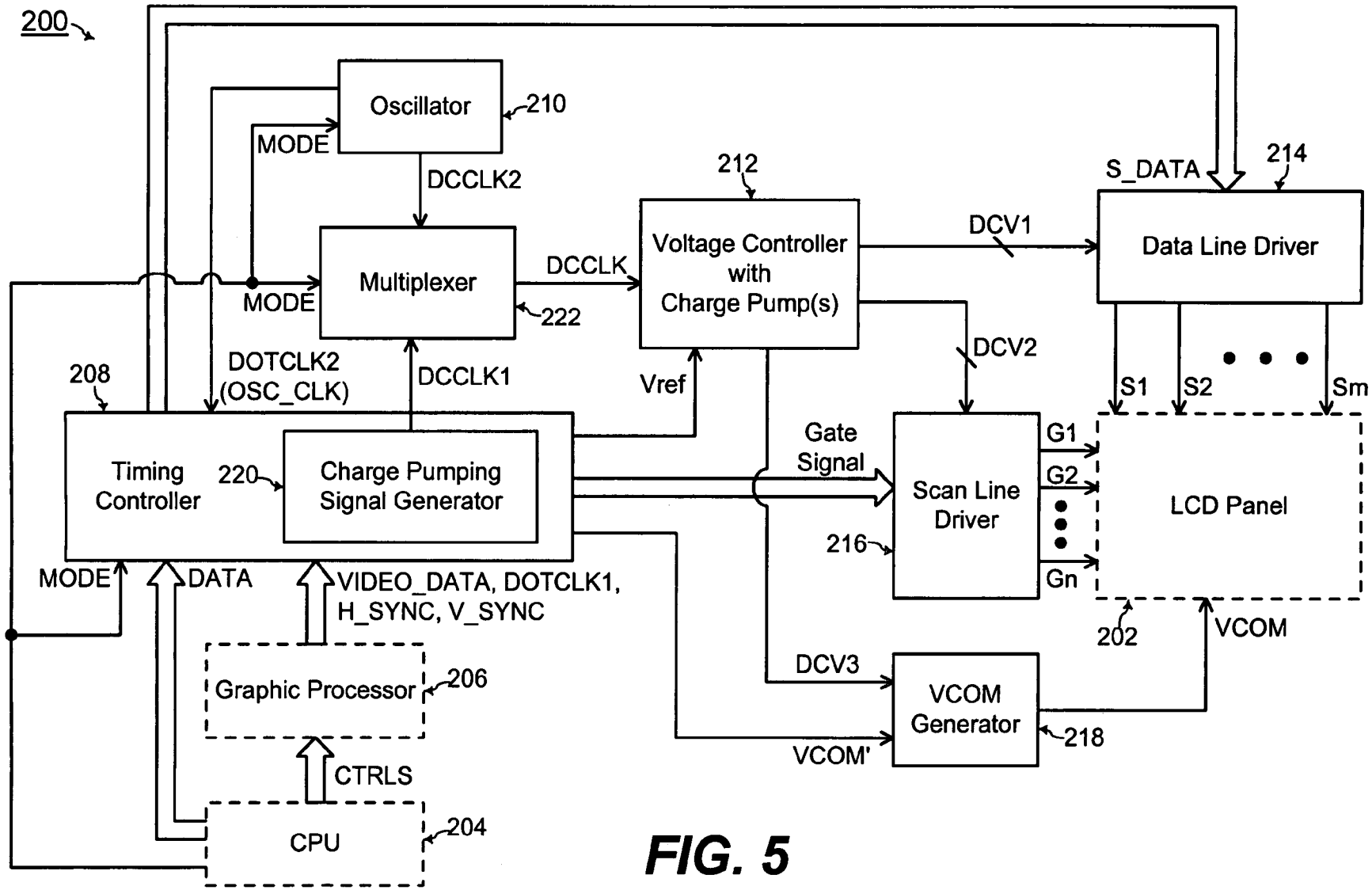
FIG. 5 shows a display driver that generates a charge pumping signal and display panel driving signals synchronized to a respective same clock signal for each of the CPU and video interface modes, according to an example embodiment of the present invention.

Referring to FIG. 5, a display driver 200 of a general aspect of the present invention generates a charge pumping signal and driving signals for a display panel 202 synchronized to a respective same clock signal for each of the CPU and video interface modes. The present invention is described for the display panel 202 being a LCD (liquid crystal display) panel. However, the present invention may also be practiced for any other types of display panels.

Figure 2:
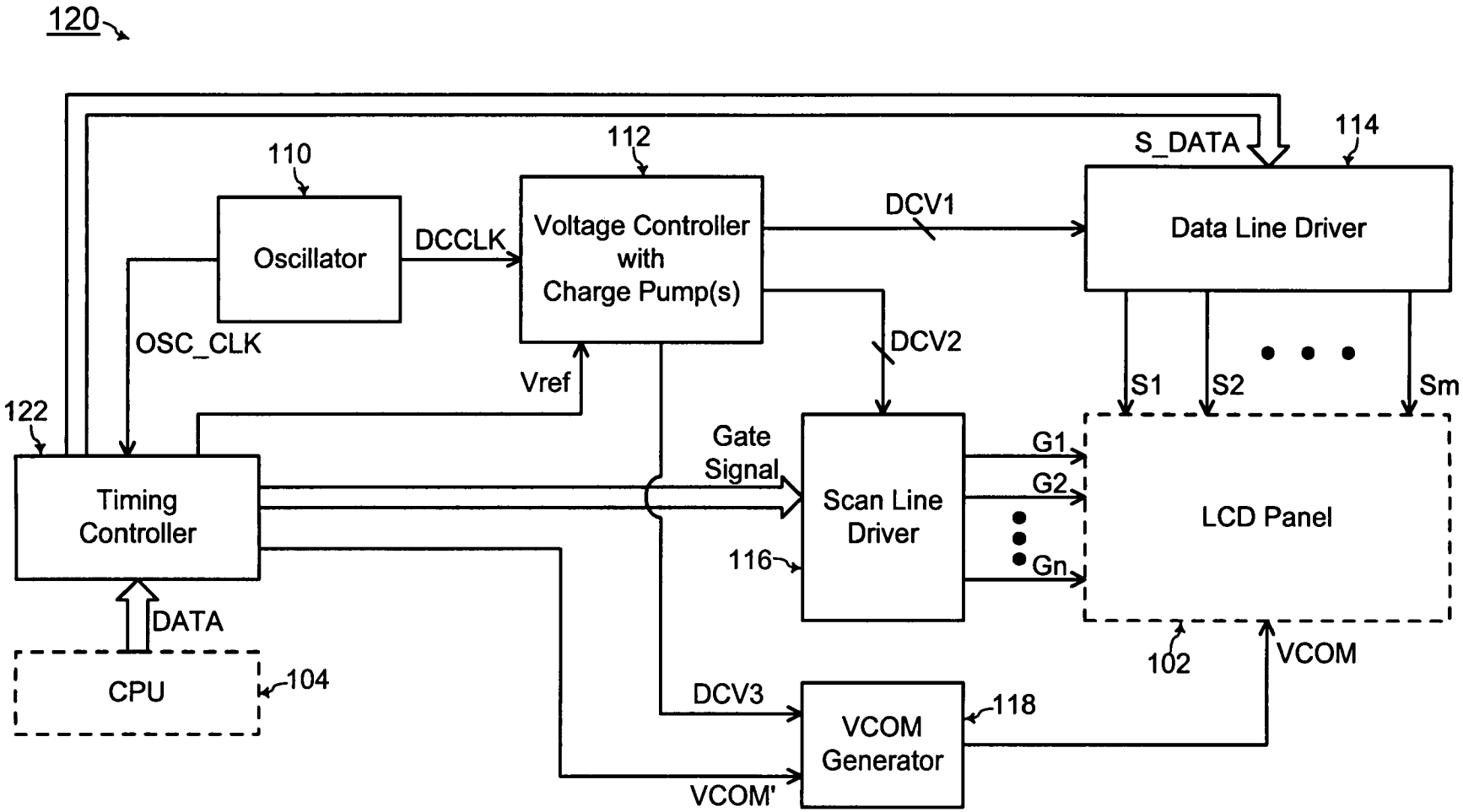
FIG. 2 (Prior Art)
FIG. 2 shows a block diagram of a display driver operating in a CPU interface mode, according to the prior art.

Components, such as the LCD panel 202, a CPU 204, and a graphic processor 206, that are not part of the display driver 200 in FIG. 2 are shown outlined in dashed lines. However, the combination of the display driver 200 with the LCD panel 202, the CPU 204, and the graphic processor 206 comprises a LCD system.

Figure 1:
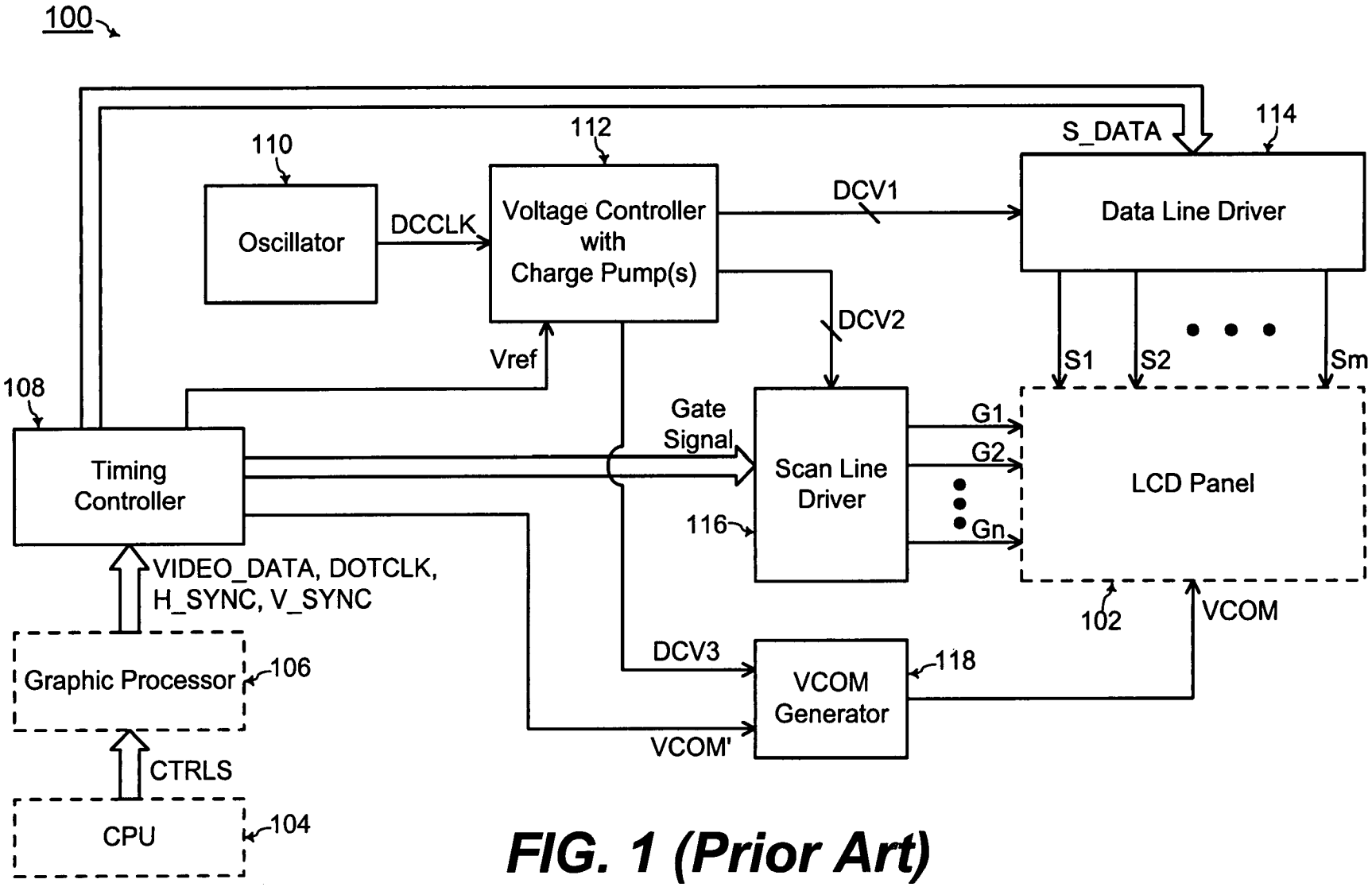
FIG. 1 (Prior Art)
FIG. 1 shows a block diagram of a display driver operating in a video interface mode, according to the prior art.

The display driver 200 of FIG. 5 includes a voltage controller 212, a data line driver 214, a scan line driver 216, and a common voltage (VCOM) generator 218, each operating similarly to the voltage controller 112, the data line driver 114, the scan line driver 116, and the VCOM generator 118, respectively, of FIGS. 1 and 2. However, a timing controller 208 of FIG. 5 includes a charge pumping signal generator 220 for generating a first charge pumping signal (DCCLK1) to be coupled to the charge pump(s) of the voltage controller 212 in the video interface mode. The graphic processor 206 provides video data (VIDEO_DATA), a first system clock signal (DOTCLK1), and synchronization signals (H_SYNC and V_SYNC) to the timing controller 208 for the video interface mode.

In addition, an oscillator 210 of FIG. 5 generates a second system clock signal (DOTCLK2) and a second charge pumping signal (DCCLK2) to be used in the CPU interface mode. A signal selector 222, implemented as a multiplexer in the example embodiment of the FIG. 5, inputs the two charge pumping signals DCCLK1 and DCCLK2 and outputs a selected charge pumping signal DCCLK to the voltage controller 212.

The CPU 204 is coupled to the timing controller 208 to provide DATA. In addition, the CPU 204 is coupled to the graphic processor 206, the timing controller 208, the oscillator 210, and the multiplexer 222 to indicate one of the video or CPU interface modes of operation.

Figure 6:
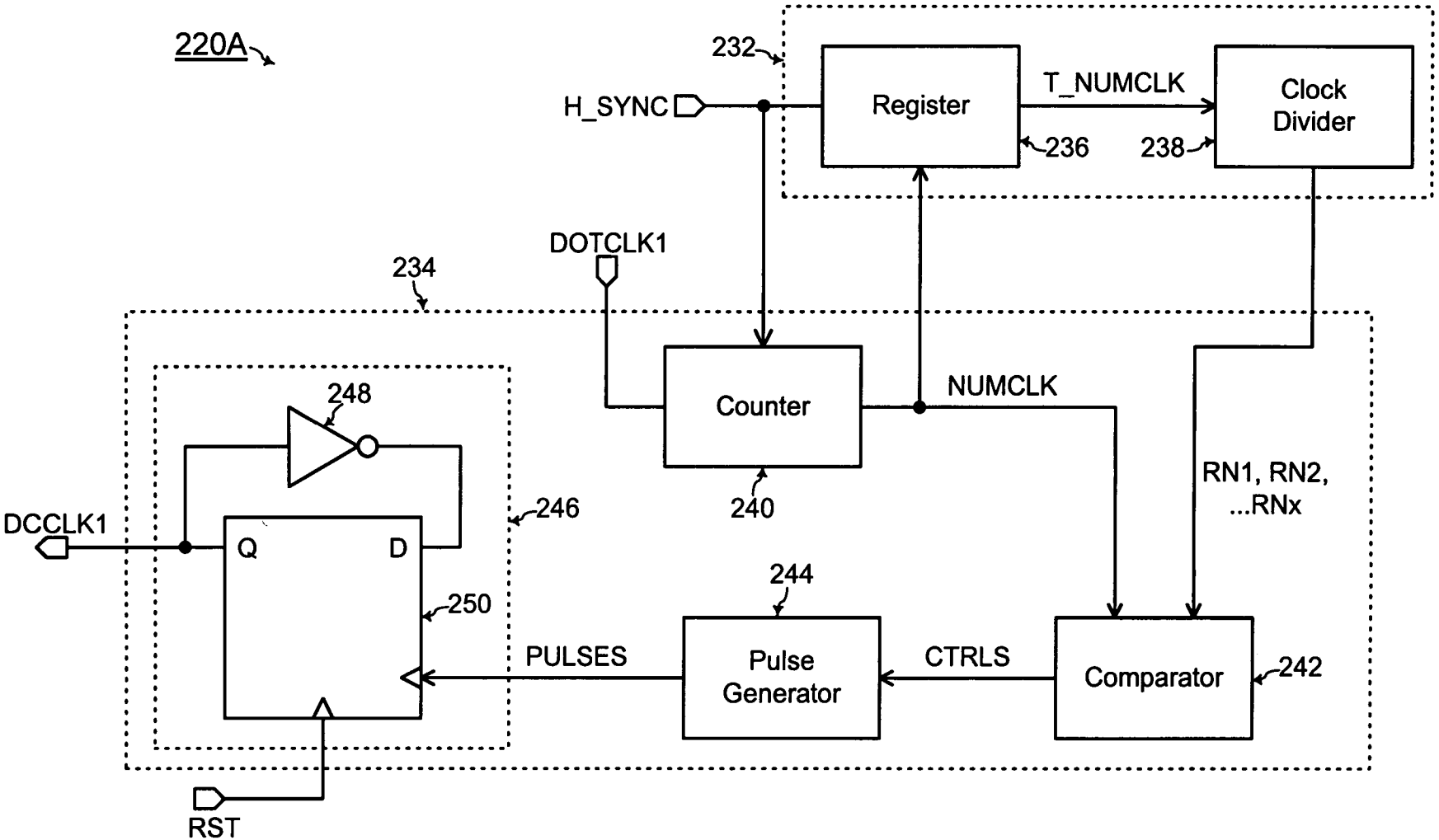
FIG. 6 shows a block diagram of a first charge pumping signal generator that generates a charge pumping signal used in a video interface mode of the display driver of FIG. 5, according to an example embodiment of the present invention.

FIG. 6 shows a block diagram for an example embodiment 220A of the charge pumping signal generator 220 in FIG. 5 for generating the first charge pumping signal (DCCLK1). The charge pumping signal generator 220A generates DCCLK1 to be synchronized to the first system clock signal (DOTCLK1) from the graphic processor 206. The charge pumping signal generator 220A includes a clock partitioner 232 and a signal transitioner 234. The clock partitioner 232 is comprised of a register 226 and a clock divider 238 in the embodiment of FIG. 6. The signal transitioner 234 is comprised of a counter 240, a comparator 242, a pulse generator 244, and a toggle flip-flop 246. The toggle flip-flop 246 is implemented with an inverter 248 in the feed-back path of a D-type flip-flop 250.

Figure 7:
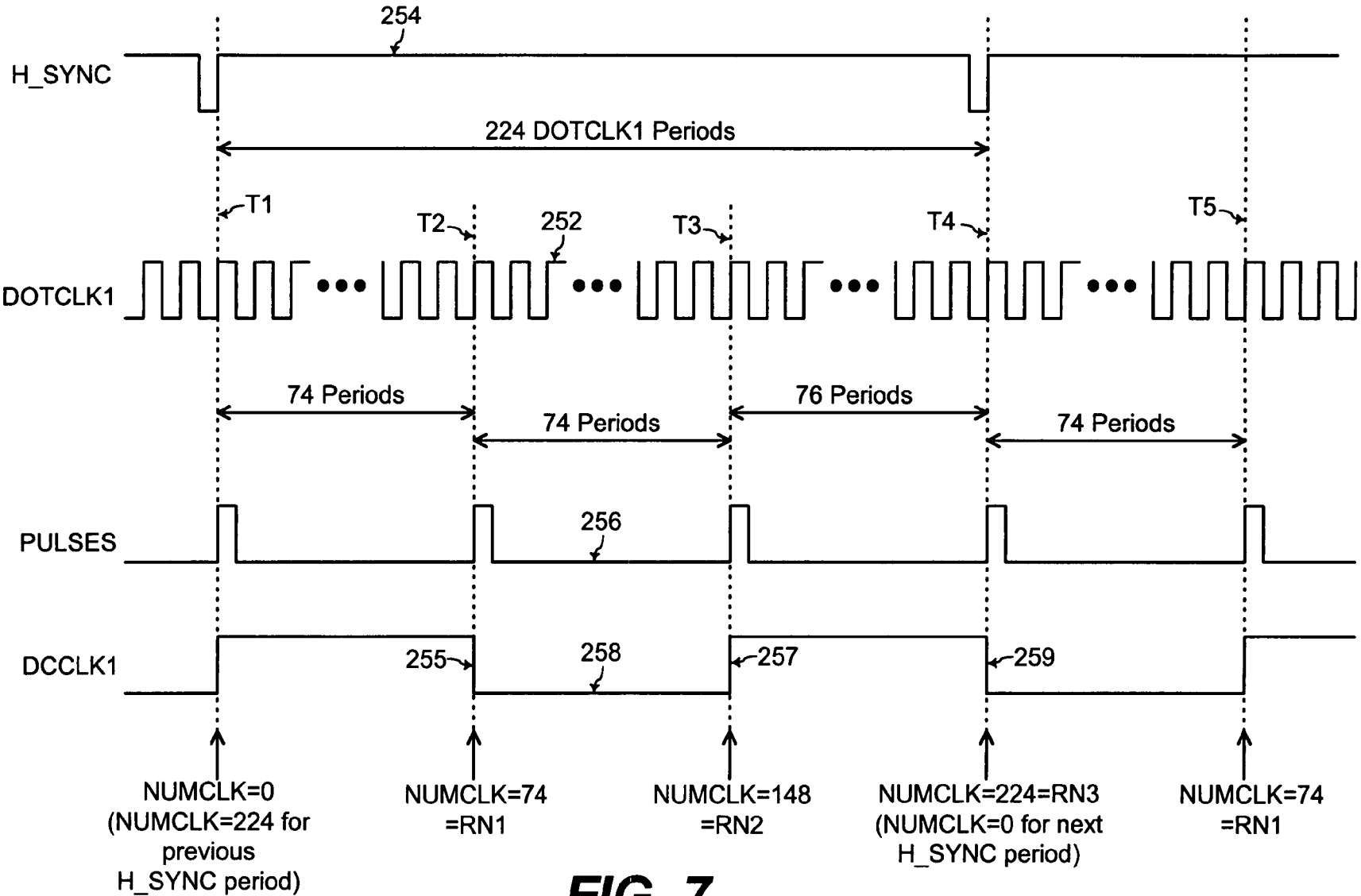
FIG. 7 shows a timing diagram of signals during operation of the first charge pumping signal generator of FIG. 6 in the video interface mode, according to an example embodiment of the present invention.
Figure 8:
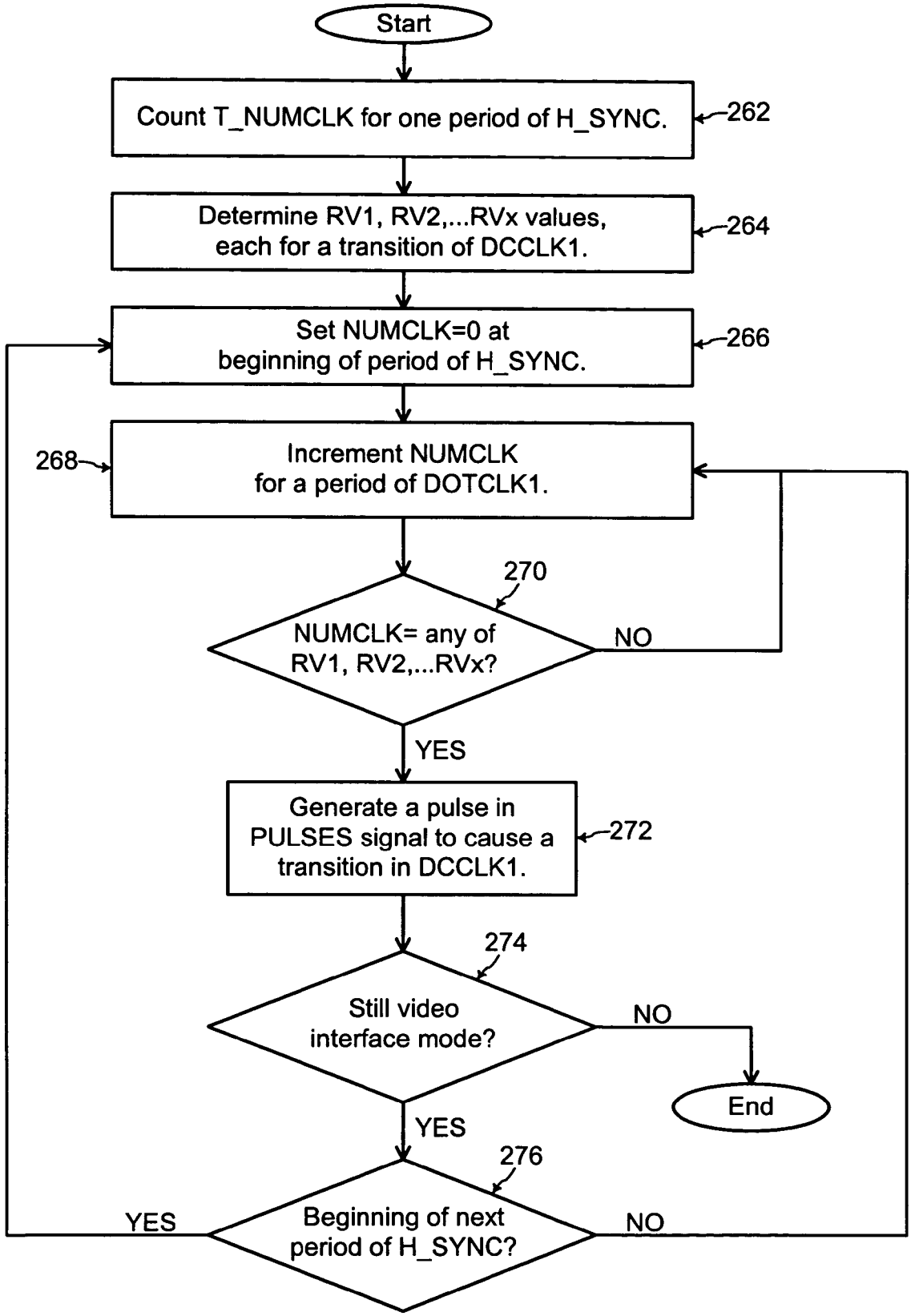
FIG. 8 shows a flowchart of steps during operation of the first charge pumping signal generator of FIG. 6 in the video interface mode, according to an example embodiment of the present invention.

Operation of the charge pumping signal generator 220A of FIG. 6 is now described in reference to the timing diagram of FIG. 7 and the flowchart of FIG. 8. Referring to FIGS. 6, 7, and 8, at the start of the video interface mode, the counter 240 counts a total number of periods (T_NUMCLK) of DOTCLK1 252 during one period of H_SYNC 254 (step 262 of FIG. 8).

In the example embodiment of FIG. 7, one period of H_SYNC starts at a first falling edge of H_SYNC at time point T1 and ends at a subsequent falling edge of H_SYNC at time point T4. The counter 240 counts a number of periods (NUMCLK) of DOTCLK1 from the beginning of each period of H_SYNC when NUMCLK is set to zero. NUMCLK is incremented by one for each period of DOTCLK1 from the beginning of the period of H_SYNC. Thus, NUMCLK counts the number of periods of DOTCLK1 during one period of H_SYNC. The register 236 stores the NUMCLK value at the end of a period of H_SYNC when NUMCLK=T_NUMCLK. In one example embodiment of the present invention, T_NUMCLK=224 periods of DOTCLK1 during one period of H_SYNC.

After determination of T_NUMCLK, the clock divider 238 determines a respective number of periods of DOTCLK1 (RN1, RN2, . . . , and RNx) from the beginning of a period of H_SYNC when a transition in DCCLK1 is to occur (step 264 of FIG. 8). The respective numbers RN1, RN2, . . . , and RNx are determined from T_NUMCLK and the desired frequency of the first charge pumping signal DCCLK1.

The desired frequency of DCCLK1 is determined from the number (m) of the data lines S1, S2, . . . , and Sm, the number (n) of the gate lines G1, G2, . . . , and Gn, and a frame rate during the video interface mode of operation for the display panel 202 as follows:

$$\text{DESIRED_FREQUENCY of DCCLK1} = m \times n \times \text{FRAME_RATE}$$

Because the frequency of DOTCLK1 is known, the clock divider 238 determines the respective numbers RN1, RN2, . . . , and RNx when a transition in DCCLK1 is to occur during a period of H_SYNC from the desired frequency of $DCCLK_1$ and T_NUMCLK. In the example embodiment of FIG. 7, the frequency of DCCLK1 is desired to be (1/148) of the frequency of DOTCLK1 when T_NUMCLK=224. Thus, the clock divider 238 sets RN1=74, RN2=148, and RN3=224 to cause three transitions in DCCLK1 during one period of H_SYNC.

Note that the respective numbers RN1, RN2, . . . , and RNx are determined during one period of H_SYNC at the beginning of the video interface mode, according to one embodiment of the present invention. Thus, image quality on the LCD display 202 is not noticeably affected during such a determination.

Referring further to FIGS. 6, 7, and 8, the respective numbers RN1, RN2, . . . , and RNx as determined by the clock divider 238 are sent to the comparator 242. For generation of DCCLK1, at a beginning of H_SYNC, the NUMCLK value within the counter 240 is set to zero (step 266 of FIG. 8). Thereafter, the counter 240 increments by one for each period of DOTCLK1 (step 268 of FIG. 8).

The comparator 242 compares NUMCLK with each of the respective numbers RN1, RN2, . . . , and RNx from the clock divider 238. If NUMCLK is equal to any of the respective numbers RN1, RN2, . . . , and RNx (step 270 of FIG. 8), the comparator 242 sends a control signal (CTRLS) to the pulse generator 244 to generate a pulse in the PULSES control signal 256 (step 272) as illustrated in FIG. 7. A pulse of the PULSES signal 256 causes a transition in the DCCLK1 generated at the Q-output of the toggle flip-flop 246.

If the DOTCLK1 and H_SYNC signal are no longer provided with an end to the video interface mode (step 274 of FIG. 8), the operation of the first charge pumping signal generator 220A ends. Otherwise, if a period of H_SYNC is not yet ended (step 276 of FIG. 8), the flowchart loops back to step 268 to repeat steps 268, 270, 272, 274, and 276 for each period of DOTCLK1 until the period of H_SYNC ends at step 276. Otherwise, if a period of H_SYNC is ended to the beginning of a next period of H_SYNC (step 276 of FIG. 8), the flowchart loops back to step 266 where NUMCLK is reset to zero, and steps 268, 270, 272, 274, and 276 are repeated for the subsequent period of H_SYNC.

In this manner, a transition is generated for DCCLK1 each time NUMCLK is equal to any of the respective numbers RN1, RN2, . . . , and RNx as determined by the clock divider 238 during each period of H_SYNC. In the example embodiment of FIG. 7, three transitions 255, 257, and 259 occur for DCCLK1 during each period of H_SYNC for RN1=74, RN2=148, and RN3=224, respectively.

Note that 74 periods of DOTCLK1 occur between time point T1 (at the beginning of a period of H_SYNC) and time point T2 (at the first transition 255 during the period of H_SYNC). In addition, 74 periods of DOTCLK1 occur between time point T2 and time point T3 (at the second transition 257 during the period of H_SYNC). Then, 76 periods of DOTCLK1 occur between time point T3 and time point T4 (at the third transition 259 during the period of H_SYNC). The clock divider 238 may not be able to generate perfectly equal number of periods of DOTCLK1 between each of the respective numbers RN1, RN2, . . . , and RNx. Nevertheless, the resulting DCCLK1 258 has substantially regular periods and still has a frequency that is substantially equal to the desired frequency for DCCLK1 258.

Figure 9:
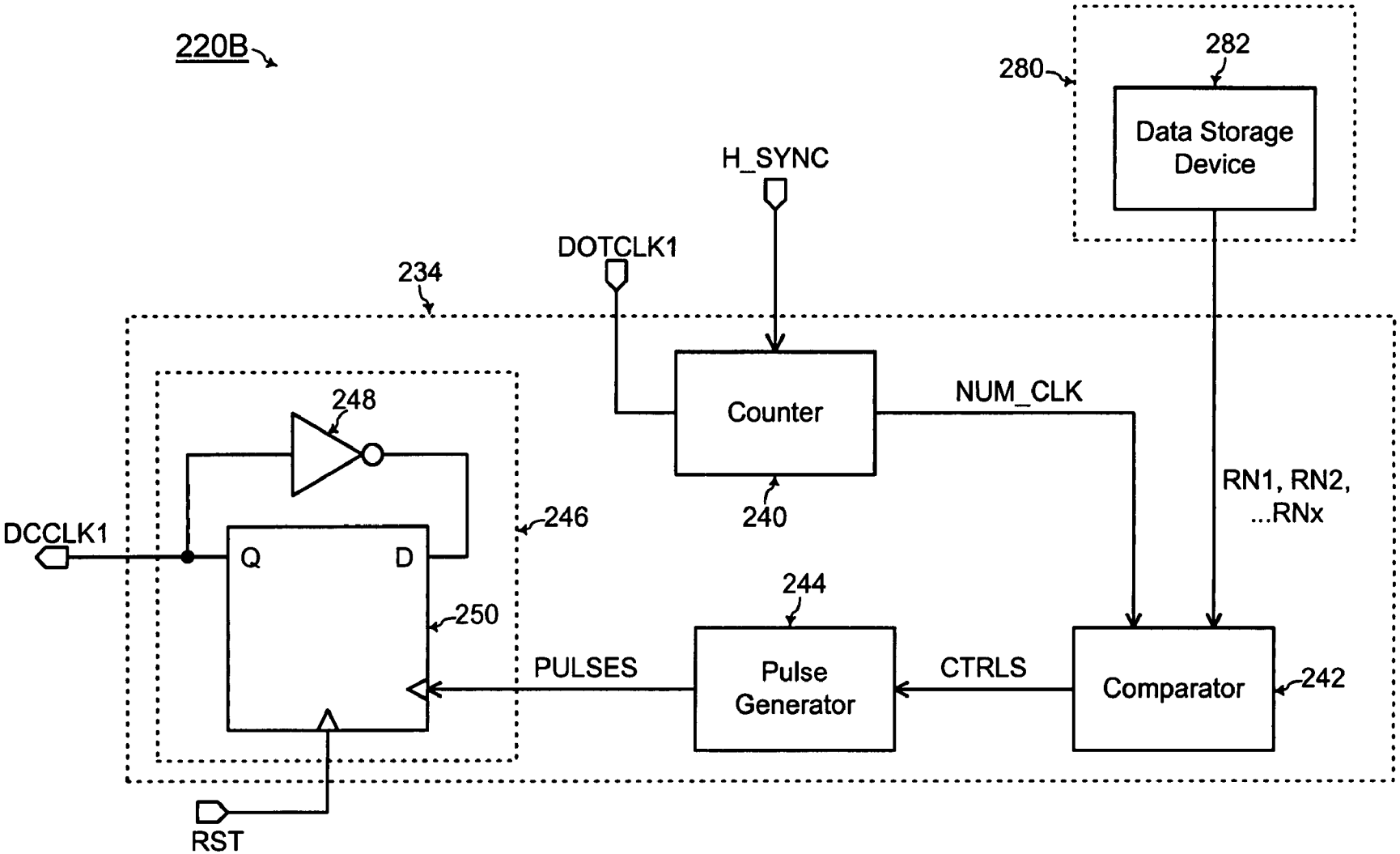
FIG. 9 shows a block diagram of an alternative embodiment of the first charge pumping signal generator within the display driver of FIG. 5.

FIG. 9 shows a block diagram of an alternative embodiment 220B of the charge pumping signal generator 220 in FIG. 5 for generating the first charge pumping signal (DCCLK1). Elements having the same reference number in FIGS. 6 and 9 refer to elements having similar structure and function. However, a clock partitioner 280 in FIG. 9 is different from the clock partitioner 232 of FIG. 6. In FIG. 9, the clock partitioner 280 is comprised of a data storage device 282 for storing the respective numbers RN1, RN2, . . . , and RNx when each transition in DCCLK1 is to occur. A designer of the display system of FIG. 5 determines and programs such respective numbers RN1, RN2, . . . , and RNx into the data storage device 282.

Figure 10:
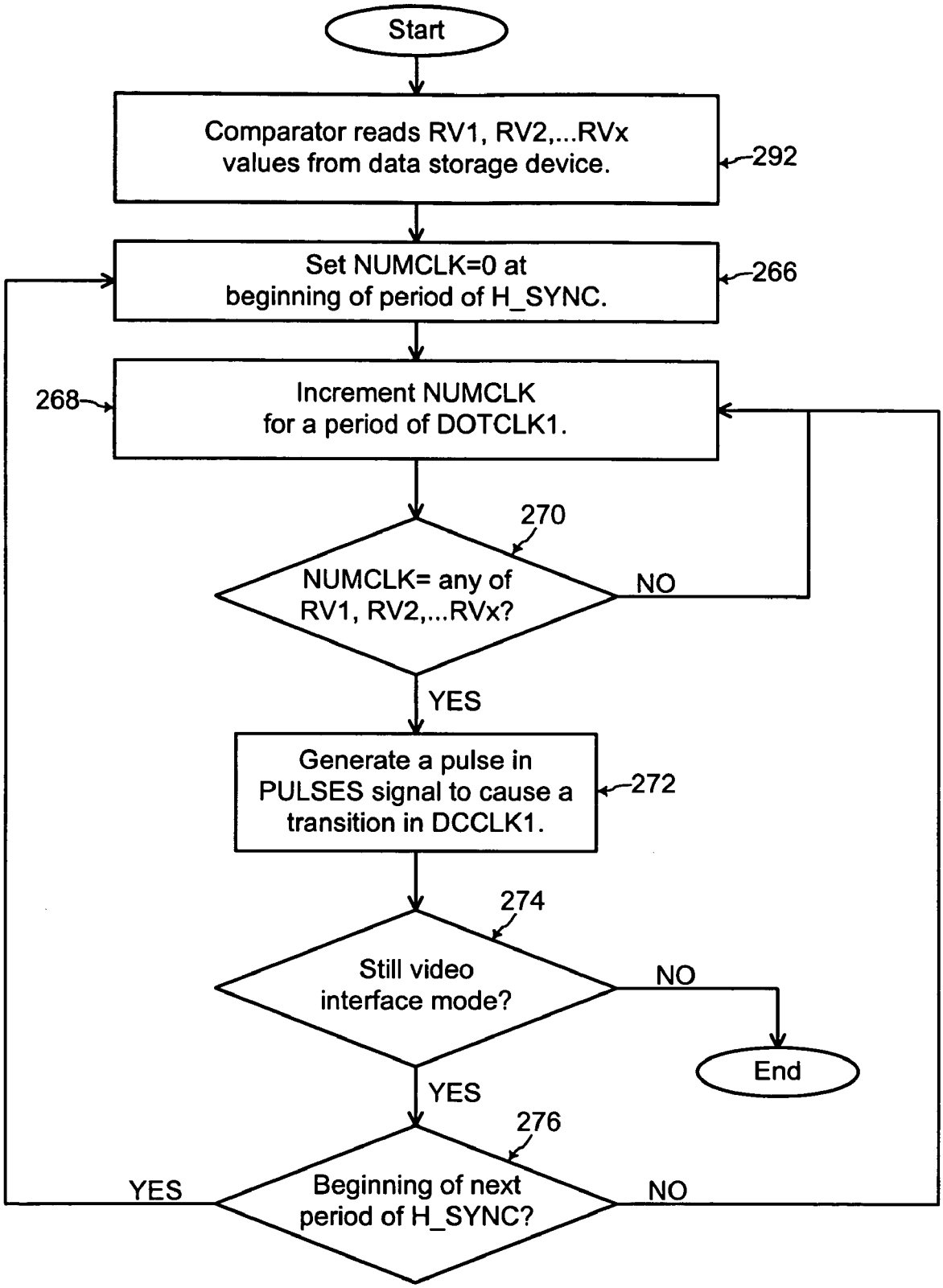
FIG. 10 shows a flowchart of steps during operation of the first charge pumping signal generator of FIG. 9 in the video interface mode, according to an example embodiment of the present invention.

FIG. 10 shows a flowchart of steps during operation of the charge pumping signal generator 220B of FIG. 9. Steps having the same reference number in FIGS. 8 and 10 reflect similar operation of the charge pumping signal generators 220A and 220B of FIGS. 6 and 9. One difference between the flowcharts of FIGS. 8 and 10 is that at step 292 of FIG. 10, the comparator 242 reads the RN1, RN2, . . . , and RNx values from the data storage device 282. Otherwise, the operation of the charge pumping signal generators 220B of FIG. 9 is similar to that 220A of FIG. 6 with a similar timing diagram of FIG. 7.

Referring back to the display driver 200 of FIG. 5, the charge pumping signal generator 220 within the timing controller 208 generates the first charge pumping signal DCCLK1 according to any of such embodiments 220A and 220B of FIGS. 6 and 9. Thus, the first charge pumping signal DCCLK1 is generated to be synchronized to the first system clock signal DOTCLK1 from the graphic processor 206.

Figure 3:
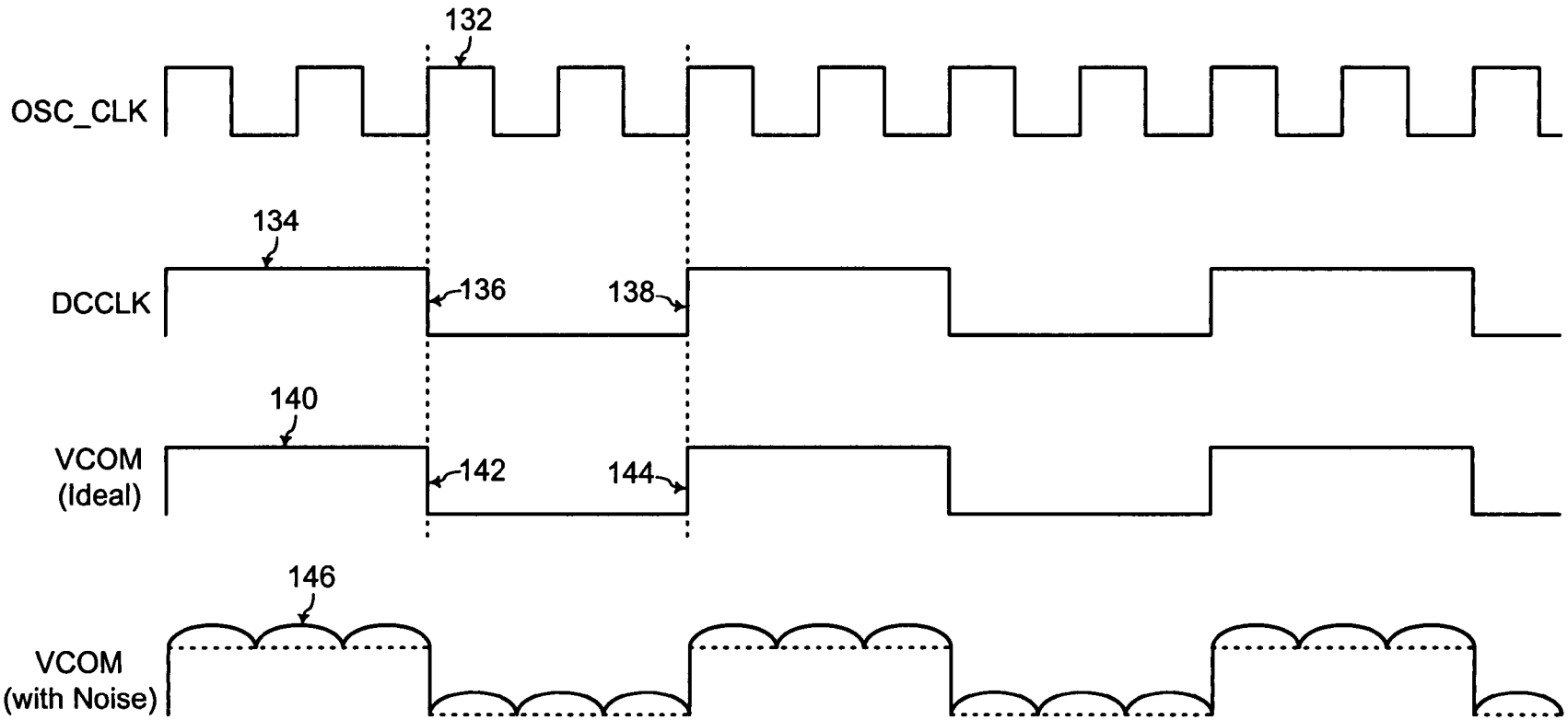
FIG. 3 (Prior Art)
FIG. 3 shows a timing diagram of signals during operation of the display driver of FIG. 2 in the CPU interface mode, according to the prior art.
Figure 4:
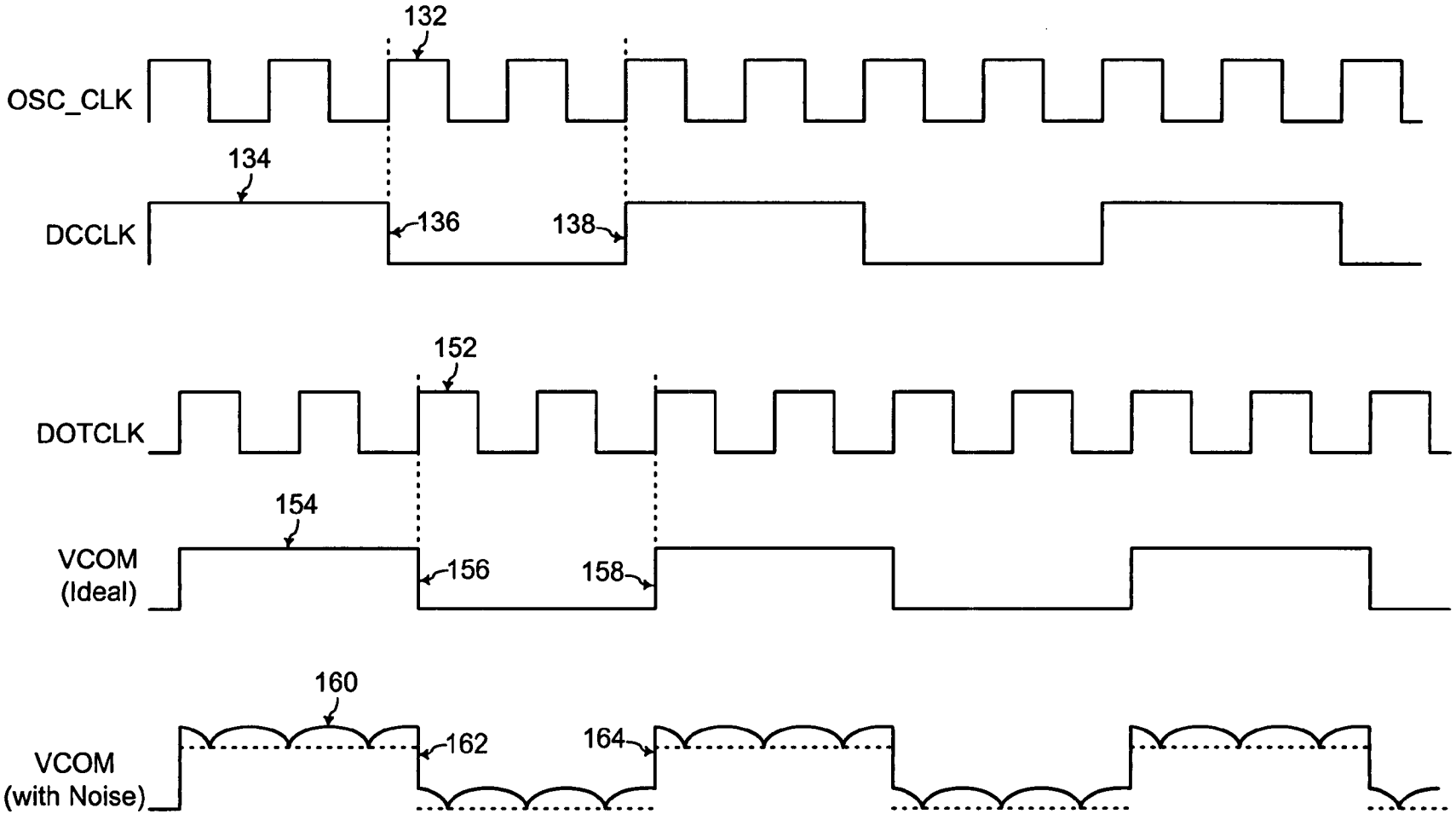
FIG. 4 (Prior Art)
FIG. 4 shows a timing diagram of signals during operation of the display driver of FIG. 1 in the video interface mode, according to the prior art.

The oscillator 210 generates a second system clock signal DOTCLK2 which is similar to the OSC_CLK signal 132 of FIGS. 3 and 4. In addition, the oscillator 210 generates the second charge pumping signal DCCLK2 to be synchronized to DOTCLK2. For example, a frequency divider is used within the oscillator 210 to generate DCCLK2 having a period that is an integer multiple of the period of the DOTCLK2.

Figure 11:
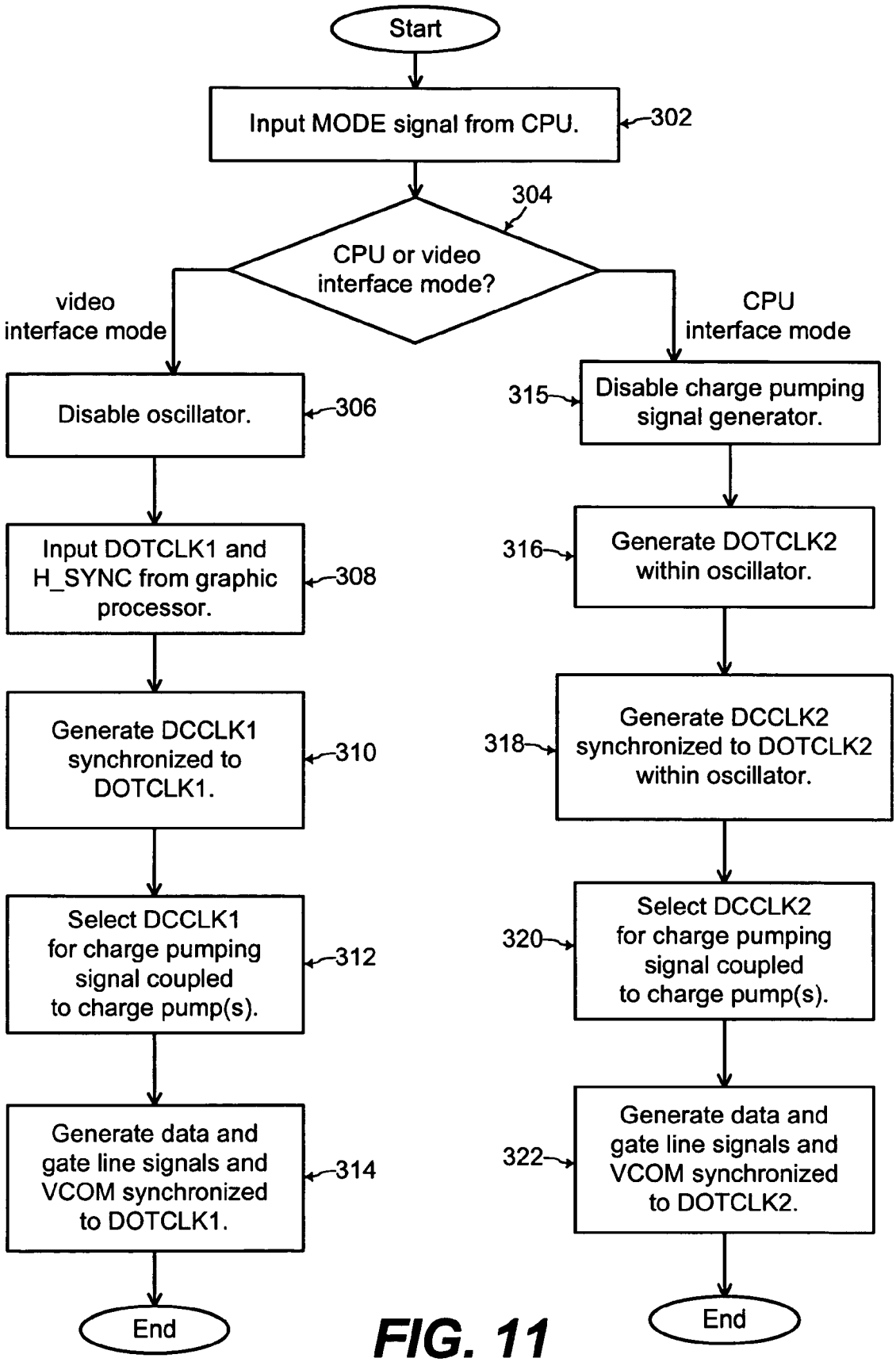
FIG. 11 shows a flowchart of steps during operation of the display driver of FIG. 5 for both the CPU and video interface modes, according to an example embodiment of the present invention.

Operation of the display driver 200 of FIG. 5 for the video and CPU interface modes is now described in reference to the flowchart of FIG. 11. The CPU 204 generates a MODE signal indicating whether the display driver 200 is to operate in the video interface mode or the CPU interface mode. If a still image is to be generated on the LCD panel 202, the CPU 204 dictates that the display driver 200 is to operate in the CPU interface mode. Alternatively, if moving video images are to be generated on the LCD panel 202, the CPU 204 dictates that the display driver 200 is to operate in the video interface mode.

Referring to FIGS. 5 and 11, the display driver 200 inputs the MODE signal from the CPU 204 indicating the display driver 200 is to operate in the video interface mode or the CPU interface mode (step 302 of FIG. 11). If the MODE signal from the CPU 204 indicates that the display driver 200 is to operate in the video interface mode (step 304 of FIG. 11), steps 306, 308, 310, 312, and 314 are performed. Alternatively, if the MODE signal from the CPU 204 indicates that the display driver 200 is to operate in the CPU interface mode (step 304 of FIG. 11), steps 316, 318, 320, and 322 are performed.

When the MODE signal from the CPU 204 indicates that the display driver 200 is to operate in the video interface mode, the oscillator 210 is disabled (step 306 of FIG. 11) for conserving power in one embodiment of the present invention. In addition, in the video interface mode, the graphic processor 206 provides the VIDEO_DATA, the first system clock DOTCLK1 signal, and the synchronization signals (H_SYNC and V_SYNC) to the timing controller 208.

The charge pumping signal generator 220 inputs DOTCLK1 and H_SYNC from the graphic processor 206 (step 308 of FIG. 11) and generates DCCLK1 (step 310 of FIG. 11) as already described herein. The signal selector 222 which is implemented as a multiplexer in one embodiment of the present invention selects the first charge pumping signal DCCLK1 (step 312 of FIG. 11) generated from the charge pumping signal generator 220 as the charge pumping signal DCCLK in the video interface mode. The selected charge pumping signal DCCLK1 is used to pump the charge pump(s) within the voltage controller 212 to generate the DC voltages DCV1, DCV2, and DCV3.

In addition for the video interface mode, the timing controller 208 controls the data line driver 214, the scan line driver 216, and the VCOM generator 218 to generate driving signals synchronized to the first system clock signal DOTCLK1 (step 314 of FIG. 11) from the graphic processor 206. Such driving signals applied on the LCD panel 202 include: the respective data line signal applied on each of the data lines S1, S2, . . . , and Sm after being generated by the data line driver 214; the respective gate line signal applied on each of gate lines G1, G2, . . . , and Gn after being generated by the scan line driver 216; and the VCOM signal applied on the common node of the LCD panel 202 after being generated by the VCOM generator 218.

In this manner, the display driver 200 uses the first charge pumping signal DCCLK1 that is synchronized to a same system clock signal DOTCLK1 to which the driving signals are also synchronized, in the video interface mode. Thus, noise superimposed on the driving signals is regular and uniform across the whole display panel 202 (similar in appearance to the VCOM signal 146 of FIG. 3). Affects of such regular noise on the display panel 202 are not noticeable to the human eye in the video interface mode.

Alternatively, when the MODE signal from the CPU 204 indicates that the display driver 200 is to operate in the CPU interface mode, the charge pumping signal generator 220 is disabled (step 315 of FIG. 11) for conserving power in one embodiment of the present invention. Instead, the oscillator 210 generates the second system clock signal DOTCLK2 (step 316 of FIG. 11). In addition for the CPU interface mode, the oscillator 210 also generates the second charge pumping signal DCCLK2 synchronized to DOTCLK2 (step 318 of FIG. 11). The signal selector 222 in that case selects the second charge pumping signal DCCLK2 (step 320 of FIG. 11) as the charge pumping signal DCCLK in the CPU interface mode. The selected charge pumping signal DCCLK2 is used to pump the charge pump(s) within the voltage controller 212 to generate the DC voltages DCV1, DCV2, and DCV3.

In addition for the CPU interface mode, the timing controller 208 controls the data line driver 214, the scan line driver 216, and the VCOM generator 218 to generate the driving signals applied on the LCD panel 202 to be synchronized to the second system clock signal DOTCLK2 (step 322 of FIG. 11) from the oscillator 210. Such driving signals applied on the LCD panel 202 include: the respective data line signal applied on each of the data lines S1, S2, . . . , and Sm after being generated by the data line driver 214; the respective gate line signal applied on each of gate lines G1, G2, . . . , and Gn after being generated by the scan line driver 216; and the VCOM signal applied on the common node of the LCD panel 202 after being generated by the VCOM generator 218.

In this manner, the display driver 200 uses the second charge pumping signal DCCLK2 that is synchronized to a same system clock signal DOTCLK2 to which the driving signals are also synchronized, in the CPU interface mode. Thus, noise superimposed on the driving signals is regular and uniform across the whole display panel 202 (similar in appearance to the VCOM signal 146 of FIG. 3). Affects of such regular noise on the display panel 202 are not noticeable to the human eye in the CPU interface mode.

Accordingly, the display driver 200 generates a respective charge pumping signal and respective driving signals synchronized to a respective same clock signal for each of the CPU and video interface modes. Thus, noise superimposed on the driving signals is regular and uniform across the whole display panel 202 such that affects of such noise on the display panel 202 are not noticeable to the human eye in both the video interface mode and the CPU interface mode.

The foregoing is by way of example only and is not intended to be limiting. For example, the present invention is described for the display panel 202 being a LCD (liquid crystal display) panel. However, the present invention may also be applied for other types of display panels. In addition, the components illustrated and described herein for an example embodiment of the present invention may be implemented with any combination of hardware and/or software and in discrete and/or integrated circuits. In addition, any number as illustrated and described herein is by way of example only. For example, any number of data lines, scan lines, frame rates, and periods of the DOTCLK1 signals, as illustrated and described herein are by way of example only.

Figure 12:
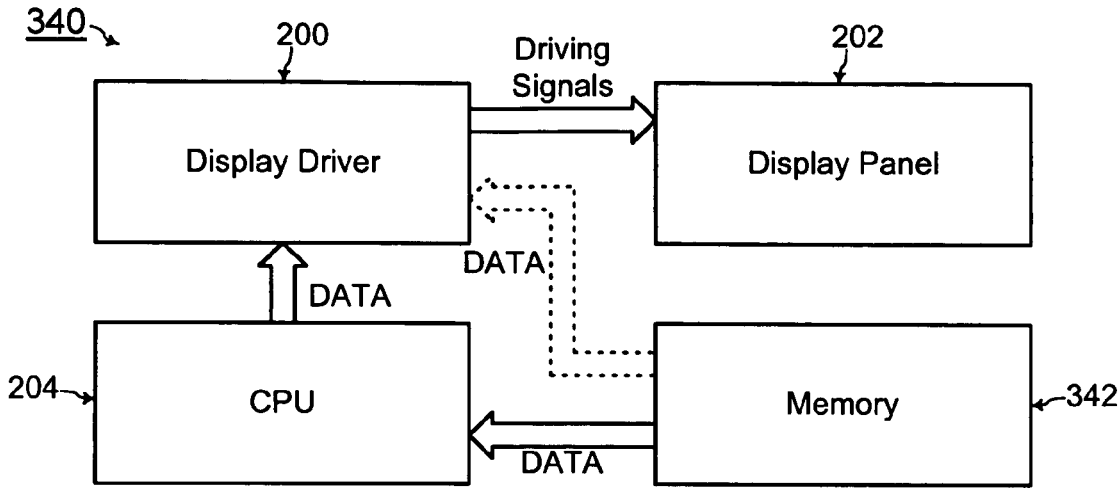
FIG. 12 shows a block diagram illustrating a source of data processed by the display driver of FIG. 5 in the CPU interface mode, according to an example embodiment of the present invention.

In addition, signal paths as illustrated and described herein are by way of example only. For example, FIG. 12 illustrates a display system 340 with the display driver 200 of FIG. 5 operating in the CPU interface mode. Elements having the same reference number in FIGS. 5 and 12 refer to elements having similar structure and function. In FIG. 12, the DATA to be processed by the display driver 200 in the CPU interface mode may be supplied by the CPU 204 after reading such DATA from a memory device 342. Alternatively, the DATA to be processed by the display driver 200 in the CPU interface mode may be read directly by the display driver 200 from the memory device 342.

Figure 13:
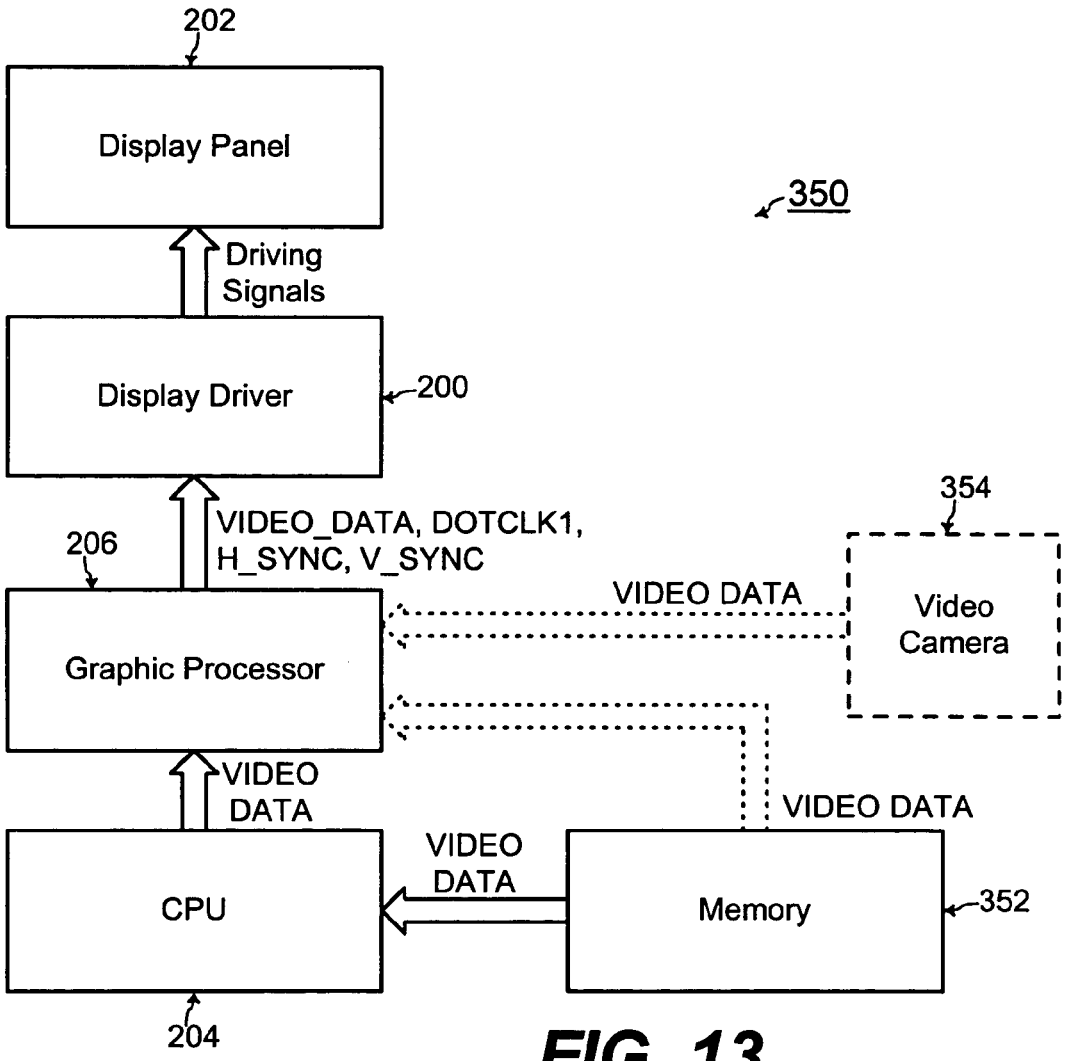
FIG. 13 shows a block diagram illustrating a source of data processed by the display driver of FIG. 5 in the video interface mode, according to an example embodiment of the present invention.

Similarly, FIG. 13 illustrates a display system 350 with the display driver 200 of FIG. 5 operating in the video interface mode. Elements having the same reference number in FIGS. 5 and 13 refer to elements having similar structure and function. In FIG. 13, the VIDEO_DATA to be processed by the display driver 200 in the video interface mode may be supplied by the CPU 204 to the graphic processor 206 after reading such VIDEO_DATA from a memory device 352. Alternatively, the VIDEO_DATA may be read directly by the graphic processor 206 from the memory device 352, or the VIDEO_DATA may be supplied to the graphic processor 206 from a video camera 354.

The present invention is limited only as defined in the following claims and equivalents thereof.

The invention claimed is:

1. A display driver, comprising:

a first signal generator that generates a first charge pumping signal (DCCLK1) synchronized to a first system clock signal (DOTCLK1), wherein the first charge pumping signal is used for charge pumping in a video interface mode; and a second signal generator that generates a second charge pumping signal (DCCLK2) synchronized to a second system clock signal (DOTCLK2), wherein the second charge pumping signal is used for charge pumping in a CPU interface mode, and wherein the first and second clock signals are from different sources;

and wherein a common signal (VCOM) applied to a common node of the display panel is synchronized to the first charge pumping signal (DCCLK1) during the video interface mode and synchronized to the second charge pumping signal (DCCLK2) during the CPU interface mode, and wherein the video interface mode is for processing data based on the first system clock signal, and wherein the CPU interface mode is for processing data based on the second system clock signal.

2. The display driver of claim 1, wherein the first system clock signal (DOTCLK1) is from a graphic processor, and wherein the second signal generator includes an oscillator that generates the second system clock signal (DOTCLK2) and the DCCLK2 synchronized to DOTCLK2.

3. The display driver of claim 1, further comprising:

a charge pump that generates at least one DC voltage when pumped with the selected one of DCCLK1 or DCCLK2.

4. The display driver of claim 3, further comprising:

a signal selector that selects DCCLK1 to be coupled to the charge pump in the video interface mode, and that selects DCCLK2 to be coupled to the charge pump in the CPU interface mode.

5. The display driver of claim 4, wherein the signal selector is coupled to a data processing unit that sends a control signal indicating one of the video interface mode or the CPU interface mode.

6. The display driver of claim 3, further comprising:

a common signal generator that generates, from the at least one DC voltage, the common signal (VCOM); and a timing controller that controls timing of VCOM.

7. The display driver of claim 6, further comprising:

a data line driver that generates, from the at least one DC voltage, the data signals applied to data lines of the display panel; and a scan line driver that generates the gate signals, from the at least one DC voltage, applied to scan lines of the display panel;

wherein the timing controller controls timing of the data signals and the gate signals.

8. The display driver of claim 7, wherein the data signals and the gate signals are synchronized to DCCLK1 in the video interface mode and to DCCLK2 in the CPU interface mode.

9. The display driver of claim 1, wherein the first signal generator comprises:

a clock partitioner that indicates timing of each transition of DCCLK1 during a period of a synchronization signal (SYNC) as a respective number of periods of the first system clock signal (DOTCLK1) from a beginning of the period of SYNC; and a signal transitioner that generates a transition in DCCLK1 at each of the respective number of periods of DOTCLK1 from the beginning of the period of SYNC.

10. The display driver of claim 9, wherein the clock partitioner is coupled to a graphic processor that provides DOTCLK1 and SYNC.

11. The display driver of claim 9, wherein the clock partitioner comprises:

a register that stores a total number (T_NUMCLK) of periods of DOTCLK1 during one period of SYNC; and a clock divider that determines, from T_NUMCLK and a desired frequency of DCCLK1, the respective number of periods of DOTCLK1 for each transition of DCCLK1 during a period of SYNC.

12. The display driver of claim 11, wherein the signal transitioner comprises:

a counter that counts a number of periods (NUMCLK) of DOTCLK1 from each beginning of a period of SYNC;

a comparator that compares NUMCLK with each of the respective number of periods of DOTCLK1 as determined by the clock divider;

a pulse generator that generates a pulse when NUMCLK is equal to any of the respective number of periods of DOTCLK1; and a toggle flip-flop configured to generate a transition in DCCLK1 for each pulse received from the pulse generator.

13. The display driver of claim 9, wherein the clock partitioner comprises:

a data storage device that stores each of the respective number of periods of DOTCLK1 for each transition of DCCLK1 during a period of SYNC.

14. The display driver of claim 13, wherein the signal transitioner comprises:

a counter that counts a number of periods (NUMCLK) of DOTCLK1 from each beginning of a period of SYNC;

a comparator that compares NUMCLK with each of the respective number of periods of DOTCLK1 as stored in the data storage device;

a pulse generator that generates a pulse when NUMCLK is equal to any of the respective number of periods of DOTCLK1; and a toggle flip-flop configured to generate a transition in DCCLK1 for each pulse received from the pulse generator.

15. The display driver of claim 1, wherein the display driver is for a LCD (liquid crystal display).

16. A signal generator for generating a charge pumping signal within a display driver, comprising:

a clock partitioner that indicates timing of each transition of the charge pumping signal during a period of a synchronization signal (SYNC) as a respective number of periods of a system clock signal (DOTCLK1) from a beginning of the period of SYNC; and a signal transitioner that generates a transition of the charge pumping signal at each of the respective number of periods of DOTCLK1 from the beginning of the period of SYNC, wherein the charge pumping signal is synchronized to both the synchronization signal (SYNC) and the system clock signal (DOTCLK1) at a same time, and wherein the clock partitioner comprises:

a register that stores a total number (T_NUMCLK) of periods of DOTCLK1 during one period of SYNC; and a clock divider that determines, from T_NUMCLK and a desired frequency of the charge pumping signal, the respective number of periods of DOTCLK1 for each transition of the charge pumping signal during a period of SYNC.

17. The signal generator of claim 16, wherein the clock partitioner is coupled to a graphic processor that provides DOTCLK1 and SYNC.

18. The signal generator of claim 16, wherein the signal transitioner comprises:

a counter that counts a number of periods (NUMCLK) of DOTCLK1 from each beginning of a period of SYNC;

a comparator that compares NUMCLK with each of the respective number of periods of DOTCLK1 as determined by the clock divider;

a pulse generator that generates a pulse when NUMCLK is equal to any of the respective number of periods of DOTCLK1; and a toggle flip-flop configured to generate a transition in the charge pumping signal for each pulse received from the pulse generator.

19. The signal generator of claim 16, wherein the clock partitioner comprises:

a data storage device that stores each of the respective number of periods of DOTCLK1 for each transition of the charge pumping signal during a period of SYNC.

20. The signal generator of claim 19, wherein the signal transitioner comprises:

a counter that counts a number of periods (NUMCLK) of DOTCLK1 from each beginning of a period of SYNC;

a comparator that compares NUMCLK with each of the respective number of periods of DOTCLK1 as stored in the data storage device;

a pulse generator that generates a pulse when NUMCLK is equal to any of the respective number of periods of DOTCLK1; and a toggle flip-flop configured to generate a transition in the charge pumping signal for each pulse received from the pulse generator.

21. The signal generator of claim 16, wherein the display driver is for a LCD (liquid crystal display).

22. The signal generator of claim 16, wherein the charge pumping signal is coupled to a charge pump of the display driver during a video interface mode.

23. The signal generator of claim 16, wherein the signal generator is part of a timing controller that controls timing of driving signals applied on a display panel.

24. A display system, comprising:

a display panel;

a display driver that generates driving signals to be applied on the display panel, the display driver including:

a first signal generator that generates a first charge pumping signal (DCCLK1) synchronized to a first system clock signal (DOTCLK1), wherein the first charge pumping signal is used for charge pumping in a video interface mode; and a second signal generator that generates a second charge pumping signal (DCCLK2) synchronized to a second system clock signal (DOTCLK2), wherein the second charge pumping signal is used for charge pumping in a CPU interface mode;

and wherein the first and second clock signals are from different sources;

and wherein a common signal (VCOM) applied to a common node of the display panel is synchronized to the first charge pumping signal (DCCLK1) during the video interface mode and synchronized to the second charge pumping signal (DCCLK2) during the CPU interface mode;

and wherein the video interface mode is for processing data based on the first system clock signal, and wherein the CPU interface mode is for processing data based on the second system clock signal;

a graphic processor that provides data, the first system clock signal (DOTCLK1), and synchronization signals to the display driver in the Video interface mode; and a data processor that provides data to the display driver in the CPU interface mode.

25. The display system of claim 24, wherein the second signal generator of the display driver includes an oscillator that generates the second system clock signal (DOTCLK2) and DCCLK2 synchronized to DOTCLK2.

26. The display system of claim 24, wherein the display driver further includes:

a charge pump that generates at least one DC voltage when pumped with the selected one of DCCLK1 or DCCLK2.

27. The display system of claim 26, wherein the display driver further includes:

a signal selector that selects DCCLK1 to be coupled to the charge pump in the video interface mode, and that selects DCCLK2 to be coupled to the charge pump in the CPU interface mode.

28. The display system of claim 27, wherein the signal selector is coupled to the data processing unit that sends a control signal indicating one of the video interface mode or the CPU interface mode.

29. The display system of claim 24, wherein the first signal generator of the display driver includes:

a clock partitioner that indicates timing of each transition of DCCLK1 during a period of a synchronization signal (SYNC) as a respective number of periods of DOTCLK1 from a beginning of the period of SYNC; and a signal transitioner that generates a transition in DCCLK1 at each of the respective number of periods of DOTCLK1 from the beginning of the period of SYNC.

30. The display system of claim 29, wherein the clock partitioner comprises:

a register that stores a total number (T_NUMCLK) of periods of DOTCLK1 during one period of SYNC; and a clock divider that determines, from T_NUMCLK and a desired frequency of DCCLK1, the respective number of periods of DOTCLK1 for each transition of DCCLK1 during a period of SYNC.

31. The display system of claim 30, wherein the signal transitioner comprises:

a counter that counts a number of periods (NUMCLK) of DOTCLK1 from each beginning of a period of SYNC;

a comparator that compares NUMCLK with each of the respective number of periods of DOTCLK1 as determined by the clock divider;

a pulse generator that generates a pulse when NUMCLK is equal to any of the respective number of periods of DOTCLK1; and a toggle flip-flop configured to generate a transition in DCCLK1 for each pulse received from the pulse generator.

32. The display system of claim 29, wherein the clock partitioner comprises:

a data storage device that stores each of the respective number of periods of DOTCLK1 for each transition of DCCLK1 during a period of SYNC.

33. The display system of claim 32, wherein the signal transitioner comprises:

a counter that counts a number of periods (NUMCLK) of DOTCLK1 from each beginning of a period of SYNC;

a comparator that compares NUMCLK with each of the respective number of periods of DOTCLK1 as stored in the data storage device;

a pulse generator that generates a pulse when NUMCLK is equal to any of the respective number of periods of DOTCLK1; and a toggle flip-flop configured to generate a transition in DCCLK1 for each pulse received from the pulse generator.

34. The display system of claim 24, wherein the display system is a LCD (liquid crystal display) system.

35. A display system, comprising:

a display panel;

a display driver that generates driving signals to be applied on the display panel, the display driver including a charge pumping signal generator that includes:

a clock partitioner that indicates timing of each transition of the charge pumping signal during a period of a synchronization signal (SYNC) as a respective number of periods of a system clock signal (DOTCLK1) from a beginning of the period of SYNC; and a signal transitioner that generates a transition of the charge pumping signal at each of the respective number of periods of DOTCLK1 from the beginning of the period of SYNC;

wherein the charge pumping signal is synchronized to both the synchronization signal (SYNC) and the system clock signal (DOTCLK1) at a same time; and a graphic processor that provides data, DOTCLK1, and synchronization signals to the display driver in a video interface mode, and wherein the clock partitioner of the display driver includes:

a register that stores a total number (T_NUMCLK) of periods of DOTCLK1 during one period of SYNC; and a clock divider that determines, from T_NUMCLK and a desired frequency of the charge pumping signal, the respective number of periods of DOTCLK1 for each transition of the charge pumping signal during a period of SYNC.

36. The display system of claim 35, wherein the signal transitioner of the display driver includes:

a counter that counts a number of periods (NUMCLK) of DOTCLK1 from each beginning of a period of SYNC;

a comparator that compares NUMCLK with each of the respective number of periods of DOTCLK1 as determined by the clock divider;

a pulse generator that generates a pulse when NUMCLK is equal to any of the respective number of periods of DOTCLK1; and a toggle flip-flop configured to generate a transition in the charge pumping signal for each pulse received from the pulse generator.

37. The display system of claim 35, wherein the clock partitioner of the display driver includes:

a data storage device that stores each of the respective number of periods of DOTCLK1 for each transition of the charge pumping signal during a period of SYNC.

38. The display system of claim 37, wherein the signal transitioner of the display driver includes:

a counter that counts a number of periods (NUMCLK) of DOTCLK1 from each beginning of a period of SYNC;

a comparator that compares NUMCLK with each of the respective number of periods of DOTCLK1 as stored in the data storage device;

a pulse generator that generates a pulse when NUMCLK is equal to any of the respective number of periods of DOTCLK1; and a toggle flip-flop configured to generate a transition in the charge pumping signal for each pulse received from the pulse generator.

39. The display system of claim 35, wherein the display system is a LCD (liquid crystal display) system.

40. The display system of claim 35, wherein the signal generator within the display driver is part of a timing controller that controls timing of driving signals applied on a display panel.

41. A method of generating charge pumping signals within a display driver, comprising:

generating a first charge pumping signal (DCCLK1) synchronized to a first system clock signal (DOTCLK1), wherein the first charge pumping signal is used for charge pumping in a video interface mode;

generating a second charge pumping signal (DCCLK2) synchronized to a second system clock signal (DOTCLK2), wherein the second charge pumping signal is used for charge pumping in a CPU interface mode;

and wherein the first and second system clock signals are from different sources; and synchronizing a common signal(VCOM) applied to a common node of the display panel to the first charge pumping signal (DCCLK1) during the video interface mode and to the second charge pumping signal (DCCLK2) during the CPU interface mode, and wherein the video interface mode is for processing data based on the first system clock signal, and wherein the CPU interface mode is for processing data based on the second system clock signal.

42. The method of claim 41, further comprising:

synchronizing DCCLK1 to the first system clock signal (DOTCLK1) from a graphic processor;

generating the second system clock signal (DOTCLK2) at an oscillator; and synchronizing DCCLK2 to DOTCLK2.

43. The method of claim 41, further comprising:

selecting DCCLK1 to be used as a charge pumping signal for generating at least one DC voltage in the video interface mode; and selecting DCCLK2 to be used as the charge pumping signal for generating the at least one DC voltage in the CPU interface mode.

44. The method of claim 43, further comprising:

generating, from the at least one DC voltage, the common signal (VCOM).

45. The method of claim 43, further comprising:

generating, from the at least one DC voltage, data signals applied to data lines of the display panel; and generating gate signals, from the at least one DC voltage, applied to scan lines of the display panel, wherein the data signals and the gate signals are synchronized to DCCLK1 in the video interface mode and to DCCLK2 in the CPU interface mode.

46. The method of claim 41, wherein generating the first charge pumping signal includes:

indicating timing of each transition of DCCLK1 during a period of a synchronization signal (SYNC) as a respective number of periods of the first system clock signal (DOTCLK1) from a beginning of the period of SYNC; and generating a transition in DCCLK1 at each of the respective number of periods of DOTCLK1 from the beginning of the period of SYNC.

47. The method of claim 46, wherein indicating the timing of each transition of DCCLK1 includes:

counting a total number (T_NUMCLK) of periods of DOTCLK1 during one period of SYNC; and determining, from T_NUMCLK and a desired frequency of DCCLK1, the respective number of periods of DOTCLK1 for each transition of DCCLK1 during a period of SYNC.

48. The method of claim 47, wherein generating a transition in DCCLK1 includes:

counting a number of periods (NUMCLK) of DOTCLK1 from each beginning of a period of SYNC;

comparing NUMCLK with each of the respective number of periods of DOTCLK1 as determined from T_NUMCLK and the desired frequency of DCCLK1;

generating a pulse when NUMCLK is equal to any of the respective number of periods of DOTCLK1; and generating a transition in DCCLK1 for each of the generated pulse.

49. The method of claim 46, wherein indicating the timing of each transition of DCCLK1 includes:

storing into a data storage device each of the respective number of periods of DOTCLK1 for each transition of DCCLK1 during a period of SYNC.

50. The method of claim 49, wherein generating a transition in DCCLK1 includes:

counting a number of periods (NUMCLK) of DOTCLK1 from each beginning of a period of SYNC;

comparing NUMCLK with each of the respective number of periods of DOTCLK1 as stored in the data storage device;

generating a pulse when NUMCLK is equal to any of the respective number of periods of DOTCLK1; and generating a transition in DCCLK1 for each of the generated pulse.

51. The method of claim 41, wherein the display driver is for a LCD (liquid crystal display).

52. A method of generating a charge pumping signal within a display driver, comprising:

indicating timing of each transition of the charge pumping signal during a period of a synchronization signal (SYNC) as a respective number of periods of a system clock signal (DOTCLK1) from a beginning of the period of SYNC;

generating a transition of the charge pumping signal at each of the respective number of periods of DOTCLK1 from the beginning of the period of SYNC; and synchronizing the charge pumping signal to both the synchronization signal (SYNC) and the system clock signal (DOTCLK1) at a same time, and wherein indicating the timing of each transition includes:

counting a total number (T_NUMCLK) of periods of DOTCLK1 during one period of SYNC; and determining, from T_NUMCLK and a desired frequency of the charge pumping signal, the respective number of periods of DOTCLK1 for each transition of the charge pumping signal during a period of SYNC.

53. The method of claim 52, further comprising:

receiving DOTCLK1 and SYNC from a graphic processor.

54. The method of claim 52, wherein generating a transition of the charge pumping signal includes:

counting a number of periods (NUMCLK) of DOTCLK1 from each beginning of a period of SYNC;

comparing NUMCLK with each of the respective number of periods of DOTCLK1 as determined from T_NUMCLK and the desired frequency of the charge pumping signal;

generating a pulse when NUMCLK is equal to any of the respective number of periods of DOTCLK1; and generating a transition in the charge pumping signal for each of the generated pulse.

55. The method of claim 52, wherein indicating the timing of each transition includes:

storing into a data storage device each of the respective number of periods of DOTCLK1 for each transition of the charge pumping signal during a period of SYNC.

56. The method of claim 55, wherein generating a transition of the charge pumping signal includes:

counting a number of periods (NUMCLK) of DOTCLK1 from each beginning of a period of SYNC;

comparing NUMCLK with each of the respective number of periods of DOTCLK1 as stored in the data storage device;

generating a pulse when NUMCLK is equal to any of the respective number of periods of DOTCLK1; and generating a transition in the charge pumping signal for each of the generated pulse.

57. The method of claim 52, wherein the display driver is for a LCD (liquid crystal display).

58. The method of claim 52, wherein the charge pumping signal is used by the display driver during a video interface mode.

* * * * *